US006258257B1

(12) United States Patent
Swan, III et al.

(10) Patent No.: US 6,258,257 B1
(45) **Date of Patent: *Jul. 10, 2001**

(54) PROCESS FOR PRODUCING POLYPROPYLENE FROM $C_3$ OLEFINS SELECTIVELY PRODUCED BY A TWO STAGE FLUID CATALYTIC CRACKING PROCESS

(75) Inventors: George A. Swan, III; Michael W. Bedell, both of Baton Rouge, LA (US); Paul K. Ladwig, Randolph, NJ (US); John E. Asplin, Houston, TX (US); Gordon F. Stuntz; William A. Wachter, both of Baton Rouge, LA (US); B. Erik Henry, Katy, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/517,551

(22) Filed: Mar. 2, 2000

Related U.S. Application Data

(63) Continuation-in-part of application No. 09/073,084, filed on May 5, 1998, now Pat. No. 6,106,697.

(51) Int. Cl.[7] ..... C10G 51/02; C07C 4/06

(52) U.S. Cl. ..... 208/74; 208/72; 208/77; 585/324; 585/329; 585/330

(58) Field of Search ..... 208/74, 72, 77, 208/67; 585/324, 329, 330

(56) References Cited

U.S. PATENT DOCUMENTS

| | | | | |
|---|---|---|---|---|
| 3,442,792 | | 5/1969 | Eng et al. | 208/62 |
| 3,893,905 | * | 7/1975 | Fenske et al. | 208/103 |
| 3,928,172 | | 12/1975 | Davis, Jr. et al. | 208/77 |
| 4,171,257 | | 10/1979 | O'Rear et al. | 208/120 |
| 4,282,085 | | 8/1981 | O'Rear et al. | 208/120 |
| 4,502,945 | | 3/1985 | Olbrich et al. | 208/120 |
| 4,830,728 | | 5/1989 | Herbst et al. | 208/78 |
| 4,865,718 | | 9/1989 | Herbst et al. | 208/70 |
| 4,950,387 | | 8/1990 | Harandi et al. | 208/49 |
| 5,026,935 | | 6/1991 | Leyshon et al. | 585/315 |
| 5,026,936 | | 6/1991 | Leyshon et al. | 585/315 |
| 5,043,522 | | 8/1991 | Leysohn et al. | 585/651 |
| 5,069,776 | | 12/1991 | Biswas et al. | 208/120 |
| 5,160,424 | | 11/1992 | Le et al. | 208/67 |
| 5,171,921 | | 12/1992 | Gaffney et al. | 585/653 |
| 5,292,976 | | 3/1994 | Dessau et al. | 585/322 |
| 5,372,704 | | 12/1994 | Harandi et al. | 208/74 |
| 5,378,352 | | 1/1995 | Degnan et al. | 208/217 |
| 5,389,232 | | 2/1995 | Adewuyi et al. | 208/120 |
| 5,396,010 | | 3/1995 | Harandi et al. | 585/418 |
| 5,414,172 | | 5/1995 | Chin et al. | 585/322 |
| 5,472,594 | | 12/1995 | Tsang et al. | 208/114 |
| 5,865,987 | | 2/1999 | Borghard et al. | 208/97 |
| 5,865,988 | | 2/1999 | Collins et al. | 208/97 |
| 6,069,267 | * | 5/2000 | Ladwig et al . | 585/648 |
| 6,093,867 | * | 7/2000 | Ladwig et al. | 585/648 |
| 6,106,697 | * | 8/2000 | Swan et al. | 208/77 |
| 6,118,035 | * | 9/2000 | Fung et al. | 585/653 |

FOREIGN PATENT DOCUMENTS

| | | |
|---|---|---|
| 0347003 B1 | 5/1996 | (EP) . |
| WO98/56874 | 12/1998 | (WO) . |

* cited by examiner

*Primary Examiner*—Walter D. Griffin
(74) *Attorney, Agent, or Firm*—Michael A. Cromwell

(57) ABSTRACT

A process for producing polymers from olefins selectively produced by a two stage process for selectively producing $C_2$ to $C_4$ olefins from a gas oil or resid is disclosed herein. The gas oil or resid is reacted in a first stage comprising a fluid catalytic cracking unit wherein it is converted in the presence of conventional large pore zeolitic catalyst to reaction products, including a naphtha boiling range stream. The naphtha boiling range stream is introduced into a second stage comprising a process unit containing a reaction zone, a stripping zone, a catalyst regeneration zone, and a fractionation zone. The naphtha feed is contacted in the reaction zone with a catalyst containing from about 10 to 50 wt. % of a crystalline zeolite having an average pore diameter less than about 0.7 nanometers at reaction conditions which include temperatures ranging from about 500 to 650° C. and a hydrocarbon partial pressure from about 10 to 40 psia. Vapor products are collected overhead and the catalyst particles are passed through the stripping zone on the way to the catalyst regeneration zone. Volatiles are stripped with steam in the stripping zone and the catalyst particles are sent to the catalyst regeneration zone where coke is burned from the catalyst, which is then recycled to the reaction zone.

8 Claims, No Drawings

PROCESS FOR PRODUCING POLYPROPYLENE FROM $C_3$ OLEFINS SELECTIVELY PRODUCED BY A TWO STAGE FLUID CATALYTIC CRACKING PROCESS

CROSS-REFERENCE TO RELATED APPLICATION

This is a continuation-in-part of U.S. application Ser. No. 09/073,084 filed May 5, 1998, now U.S. Pat. No. 6,106,697.

FIELD OF THE INVENTION

The present invention relates to a process for producing polypropylene from $C_3$ olefins produced in a two-stage process for selectively producing $C_2$ to $C_4$ olefins from a gas oil or resid.

BACKGROUND OF THE INVENTION

The need for low-emissions fuels has created an increased demand for light olefins used in alkylation, oligomerization, MTBE and ETBE synthesis processes. In addition, a low cost supply of light olefins, particularly propylene, continues to be in demand to serve as feedstock for polyolefin production, particularly polypropylene production.

Fixed bed processes for light paraffin dehydrogenation have recently attracted renewed interest for increasing olefin production. However, these types of processes typically require relatively large capital investments and high operating costs. It is therefore advantageous to increase olefin yield using processes that require relatively small capital investment. It would be particularly advantageous to increase olefin yield in catalytic cracking processes.

While conventional fluid catalytic cracking processes are suitable for producing conventional transportation fuels, these fuels are generally unable to meet the more demanding requirements of low emissions fuels and chemical feedstock production. To augment the volume of low emission fuels, it is desirable to increase the amounts of light olefins, such as propylene, iso- and normal butylenes, and isoamylene. The propylene, isobutylene, and isoamylene can be reacted with methanol to form methyl-propyl-ethers, methyl tertiary butyl ether (MTBE), and tertiary amyl methyl ether (TAME). These are high octane blending components which can be added to gasoline to satisfy oxygen requirements mandated by legislation. In addition to enhancing the volume and octane number of gasoline, they also reduce emissions. It is particularly desirable to increase the yield of ethylene and propylene, which are valuable chemical raw materials. Conventional fluid catalytic cracking does not produce large enough quantities of these light olefins, particularly ethylene. Consequently, there exits a need in the art for methods of producing larger quantities of ethylene and propylene for chemicals raw materials, and other light olefins for low-emissions transportation fuels, such as gasoline and distillates.

A problem inherent in producing olefin products using FCC units is that the process depends upon a specific catalyst balance to maximize production. In addition, even if a specific catalyst balance can be maintained to maximize overall olefin production, olefin selectivity is generally low due to undesirable side reactions, such as cracking, isomerization, aromatization and hydrogen transfer reactions. Therefore, it is desirable to maximize olefin production in a process that allows a high degree of control over the selectivity of $C_2$, $C_3$, and $C_4$ olefins.

SUMMARY OF THE INVENTION

Gas oil or resid is reacted in a first stage comprising a fluid catalytic cracking unit wherein it is converted in the presence of conventional large pore zeolitic catalyst to reaction products, including a naphtha boiling range stream. The naphtha boiling range stream is introduced into a second stage comprising a process unit containing a reaction zone, a stripping zone, a catalyst regeneration zone, and a fractionation zone. The naphtha feed is contacted in the reaction zone with a catalyst containing from about 10 to 50 wt. % of a crystalline zeolite having an average pore diameter less than about 0.7 nanometers at reaction conditions which include temperatures ranging from about 500 to 650° C. and a hydrocarbon partial pressure from about 10 to 40 psia (about 70–about 280 kPa). Vapor products are collected overhead and the catalyst particles are passed through the stripping zone on the way to the catalyst regeneration zone. Volatiles are stripped with steam in the stripping zone and the catalyst particles are sent to the catalyst regeneration zone where coke is burned from the catalyst, which is then recycled to the reaction zone.

One embodiment of the present invention comprises a process for producing polypropylene from olefins produced in a two stage process for selectively producing $C_2$ to $C_4$ olefins from a heavy hydrocarbon feed, the process comprising the steps of (a) contacting a heavy hydrocarbon feed with a large-pore zeolitic catalytic cracking catalyst having an average pore diameter greater than about 0.7 nm in a first reaction stage comprising a fluid catalytic cracking unit to convert the heavy hydrocarbon feed to lower boiling reaction products; (b) fractionating said lower boiling reaction products into at least a naphtha boiling range fraction comprising between about 10 and about 30 wt. % paraffins and between about 15 and about 70 wt. % olefins; (c) contacting the naptha boiling range fraction with a second catalyst comprising between about 10 and about 50 wt. % of a crystalline zeolite having an average pore diameter less than about 0.7 nm in a second reaction stage comprising a process unit comprising a reaction zone, a stripping zone, a second catalyst regeneration zone, and a fractionation zone, wherein the naphtha boiling range fraction is contacted with the second catalyst in the reaction zone at reaction conditions which include temperatures ranging from about 500 to 650° C. and a hydrocarbon partial pressure from about 10 to about 40 psia (about 70–about 280 kPa) and a catalyst to second stage feed weight ratio of about 4 to about 10, and wherein propylene comprises at least about 90 mol. % of the total $C_3$ product; (d) passing catalyst particles through the stripping zone; (e) passing the stripped second catalyst particles to the regeneration zone where coke is combusted from the second catalyst; (f) recycling the hot catalyst particles to the second stage reaction zone; and, (g) separating the propylene and polymerizing the propylene to form polypropylene.

In another embodiment of the present invention the second stage catalyst is a ZSM-5 type catalyst.

In another embodiment of the present invention the second stage feed contains about 10 to 30 wt. % paraffins, and from about 20 to 70 wt. % olefins.

In yet another embodiment of the present invention the second stage reaction zone is operated at a temperature from about 525° C. to about 600° C.

DETAILED DESCRIPTION OF THE INVENTION

Catalytic cracking is an established and widely used process in the petroleum refining industry for converting petroleum oils of relatively high boiling point to more valuable lower boiling products, including gasoline and middle distillates, such as kerosene, jet fuel and heating oil. The pre-eminent catalytic cracking process now in use is the fluid catalytic cracking process (FCC) in which a pre-heated feed is brought into contact with a hot cracking catalyst in the form of a fine powder, typically having a particle size of about 10–300 microns, usually about 60–70 microns, for the desired cracking reactions to take place. During the cracking, coke and hydrocarbonaceous material are deposited on the catalyst particles. This results in a loss of catalyst activity and selectivity. The coked catalyst particles, and associated hydrocarbon material, are subjected to a stripping process, usually with steam, to remove as much of the hydrocarbon material as technically and economically feasible. The stripped particles containing non-strippable coke, are removed from the stripper and sent to a regenerator where the coked catalyst particles are regenerated by contact with air, or a mixture of air and oxygen, at an elevated temperature. This results in the combustion of the coke. The combustion is a strongly exothermic reaction that removes the coke and heats the catalyst to the temperatures appropriate for the endothermic cracking reaction. The process is carried out in an integrated unit comprising the cracking reactor, the stripper, the regenerator, and the appropriate ancillary equipment. The catalyst is continuously circulated from the reactor or reaction zone, to the stripper and then to the regenerator and back to the reactor. The circulation rate is typically adjusted relative to the feed rate of the oil to maintain a heat balanced operation in which the heat produced in the regenerator is sufficient for maintaining the cracking reaction with the circulating regenerated catalyst being used as the heat transfer medium. Typical fluid catalytic cracking processes are described in the monograph Fluid Catalytic Cracking with Zeolite Catalysts, Venuto, P. B. and Habib, E. T., Marcel Dekker Inc. N.Y. 1979, which is incorporated herein by reference. As described in this monograph, catalysts which are conventionally used are based on zeolites, especially the large pore synthetic faujasites, zeolites X and Y.

Typical heavy hydrocarbon feeds to a catalytic cracker can generally be characterized as being a relatively high boiling oil or residuum, either on its own, or mixed with other fractions, also usually of a relatively high boiling point. The most common feeds are gas oils, that is, high boiling, non-residual oils, with an initial boiling point usually above about 230° C., more commonly above about 350° C., with end points of up to about 620° C. Typical gas oils include straight run (atmospheric) gas oil, vacuum gas oil, and coker gas oils.

The feed to the first stage of the present invention is preferably a hydrocarbon fraction having an initial ASTM boiling point of about 600° F. (315° C.). These hydrocarbon fractions include gas oils (including vacuum gas oils), thermal oils, residual oils, cycle stocks, topped whole crudes, tar sand oils, shale oils, synthetic fuels, heavy hydrocarbon fractions derived from the destructive hydrogenation of coal, tar, pitches, asphalts, and hydrotreated feeds derived from any of the foregoing.

The feed is reacted (converted) in a first stage, preferably in a fluid catalytic cracking reactor vessel where it is contacted with a catalytic cracking catalyst that is continuously recycled to form lower boiling reaction products.

The feed can be mixed with steam or an inert gas at such conditions that will form a highly atomized stream of a vaporous hydrocarbon-catalyst mixture that undergoes reaction in the riser. Preferably, the reacting mixture flows through a riser into the reactor vessel. The reaction zone vessel is preferably operated at a temperature of about 800–1200° F. (about 425–about 650° C.) and a pressure of about 0–100 psig (100–790 kPa).

The catalytic cracking reaction is essentially quenched by separating the catalyst from the vapor. The separated vapor comprises the cracked hydrocarbon product, and the separated catalyst contains coke deposited on the catalyst during the catalytic cracking reaction.

The coke is removed from the catalyst in a regenerator vessel by combusting the coke from the catalyst. Preferably, the coke is combusted at a temperature of about 900–1400° F. (about 480–about 760° C.) and a pressure of about 0–100 psig (100–790 kPa). After the combustion step, the regenerated catalyst is recycled to the riser for contact with the primary feed.

The catalyst used in the first stage of this invention can be any catalyst which is typically used to catalytically "crack" hydrocarbon feeds. It is preferred that the acatalytic cracking catalyst comprise a crystalline tetrahedral framework oxide component. This component catalyzes the breakdown of primary products from the catalytic cracking reaction into clean products such as naphtha for fuels and olefins for chemical feedstocks. Preferably, the crystalline tetrahedral framework oxide component is selected from the group consisting of zeolites, tectosilicates, tetrahedral aluminophophates (ALPOs) and tetrahedral silicoaluminophosphates (SAPOs). More preferably, the crystalline framework oxide component is a zeolite.

Zeolites which can be employed in the first stage catalysts of the present invention include both natural and synthetic zeolites with average pore diameters greater than about 0.7 nm. These zeolites include gmelinite, chabazite, dachiardite, clinoptilolite, faujasite, heulandite, analcite, levynite, erionite, sodalite, cancrinite, nepheline, lazurite, scolecite, natrolite, offretite, mesolite, mordenite, brewsterite, and ferrierite. Included among the synthetic zeolites are zeolites X, Y, A, L, ZK-4, ZK-5, B, E, F, H, J, M, Q, T, W, Z, alpha, beta, and omega, and USY zeolites. USY zeolites are preferred.

In general, aluminosilicate zeolites are effectively used in this invention. However, the aluminum and the silicon component can be substituted for other framework components. For example, the aluminum portion can be replaced by boron, gallium, titanium or trivalent metal compositions which are heavier than aluminum. Germanium can be used to replace the silicon portion.

The catalytic cracking catalyst used in the first stage of this invention can further comprise an active porous inorganic oxide catalyst framework component and an inert catalyst framework component. Preferably, each component of the catalyst is held together with an inorganic oxide matrix component.

The active porous inorganic oxide catalyst framework component catalyzes the formation of primary products by cracking hydrocarbon molecules that are too large to fit inside the tetrahedral framework oxide component. The active porous inorganic oxide catalyst framework component of this invention is preferably a porous inorganic oxide that cracks a relatively large amount of hydrocarbons into lower molecular weight hydrocarbons as compared to an acceptable thermal blank. A low surface area silica (e.g., quartz) is one type of acceptable thermal blank. The extent of cracking can be measured in any of various ASTM tests such as the MAT (microactivity test, ASTM # D3907-8). Compounds such as those disclosed in Greensfelder, B. S., et al., *Industrial and Engineering Chemistry*, pp. 2573–83, November 1949, are desirable. Alumina, silica-alumina and silica-alumina-zirconia compounds are preferred.

The inert catalyst framework component densifies, strengthens and acts as a protective thermal sink. The inert catalyst framework component used in this invention preferably has a cracking activity that is not significantly greater than the acceptable thermal blank. Kaolin and other clays and a-alumina, titania, zirconia, quartz and silica are examples of preferred inert components.

The inorganic oxide matrix component binds the catalyst components together so that the catalyst product is hard enough to survive interparticle and reactor wall collisions. The inorganic oxide matrix can be made from an inorganic oxide sol or gel which is dried to "binds" the catalyst components together. Preferably, the inorganic oxide matrix will be comprising oxides of silicon and aluminum. It is also preferred that separate alumina phases be incorporated into the inorganic oxide matrix. Species of aluminum oxyhydroxides-γ-alumina, boehmite, diaspore, and transitional aluminas such as α-alumina, β-alumina, γ-alumina, δ-alumina, ϵ-alumina, κ-alumina, and ρ-alumina can be employed. Preferably, the alumina species is an aluminum trihydroxide such as gibbsite, bayerite, nordstrandite, or doyelite. The matrix material may also contain phosphorous or aluminum phosphate.

A naphtha boiling range fraction of the lower boiling reaction product stream from the fluid catalytic cracking unit is used as the feed to a second reaction stage to selectively produce $C_2$ to $C_4$ olefins. This feed to the second reaction stage is preferably one that is suitable for producing the relatively high $C_2$, $C_3$, and $C_4$ olefin yields. Such streams are those boiling in the naphtha range and containing from about 5 wt. % to about 35 wt. %, preferably from about 10 wt. % to about 30 wt. %, and more preferably from about 10 to 25 wt. % paraffins, and from about 15 wt. %, preferably from about 20 wt. % to about 70 wt. % olefins. The second reaction stage feed may also contain naphthenes and aromatics. Naphtha boiling range streams are typically those having a boiling range from about 65° F. to about 430° F. (about 18–about 225° C.), preferably from about 65° F. to about 300° F. (about 18–about 150° C.). Naphtha streams from other sources in the refinery can be blended with the aforementioned feed and fed to this second reaction stage.

The second reaction stage occurs in a process unit comprising a reaction zone, a stripping zone, a catalyst regeneration zone, and a fractionation zone. The second reaction stage feed is fed into the reaction zone where it contacts a source of hot, second reaction stage catalyst ("second stage catalyst"). The hot second stage catalyst vaporizes and cracks the second reaction stage feed at a temperature from about 500° C. to 650° C., preferably from about 500° C. to 600° C. The cracking reaction deposits carbonaceous hydrocarbons, or coke, on the second stage catalyst, thereby deactivating the second stage catalyst. The cracked products are separated from the coked second stage catalyst and sent to a fractionator. The coked second stage catalyst is passed through the stripping zone where volatiles are stripped from the second stage catalyst particles with steam. The stripping can be performed under low severity conditions to retain a greater fraction of adsorbed hydrocarbons for heat balance. The stripped second stage catalyst is then passed to the regeneration zone where it is regenerated by burning coke in the presence of an oxygen containing gas, preferably air. Decoking restores catalyst activity and simultaneously heats the catalyst to between 650° C. and 750° C. The hot second stage catalyst is then recycled to the reaction zone to react with fresh second reaction stage feed. Flue gas formed by burning coke in the regenerator may be treated for removal of particulates and for conversion of carbon monoxide. The cracked products from the reaction zone are sent to a fractionation zone where various products are recovered, particularly $C_2$, $C_3$, and $C_4$ fractions.

While attempts have been made to increase light olefins yields in the FCC process unit itself, the practice of the present invention uses its own distinct process unit, as previously described, which receives naphtha from a suitable source in the refinery. The reaction zone is operated at process conditions that will maximize $C_2$ to $C_4$ olefin, particularly propylene, selectivity with relatively high conversion of $C_5$+ olefins. Catalysts suitable for use in the second stage of the present invention are those which are comprising a crystalline zeolite having an average pore diameter less than about 0.7 nanometers (nm), said crystalline zeolite comprising from about 10 wt. % to about 50 wt. % of the total fluidized catalyst composition. It is preferred that the crystalline zeolite be selected from the family of medium-pore-size (<0.7 nm) crystalline aluminosilicates, otherwise referred to as zeolites. Of particular interest are the medium-pore zeolites with a silica to alumina molar ratio of less than about 75:1, preferably less than about 50:1, and more preferably less than about 40:1, although some embodiments may incorporate silica to alumina ratios greater than 40:1. The pore diameter (also sometimes referred to as effective pore diameter) can be measured using standard adsorption techniques and hydrocarbonaceous compounds of known minimum kinetic diameters. See Breck, *Zeolite Molecular Sieves,* 1974 and Anderson et al., J. Catalysis 58, 114 (1979), both of which are incorporated herein by reference.

Medium-pore-size zeolites that can be used in the practice of the present invention are described in "Atlas of Zeolite Structure Types", eds. W. H. Meier and D. H. Olson, Butterworth-Heineman, Third Edition, 1992, which is hereby incorporated by reference. The medium-pore-size zeolites generally have a pore size from about 5 Å to about 7 Å and include for example, MFI, MFS, MEL, MTW, EUO, MTT, HEU, FER, and TON structure type zeolites (IUPAC Commission of Zeolite Nomenclature). Non-limiting examples of such medium-pore-size zeolites, include ZSM-5, ZSM-12, ZSM-22, ZSM-23, ZSM-34, ZSM-35, ZSM-38, ZSM-48, ZSM-50, silicalite, and silicalite 2. The most preferred is ZSM-5, which is described in U.S. Pat. Nos. 3,702,886 and 3,770,614. ZSM-11 is described in U.S. Pat. No. 3,709,979; ZSM-12 in U.S. Pat. No. 3,832,449; ZSM-21 and ZSM-38 in U.S. Pat. No. 3,948,758; ZSM-23 in U.S. Pat. No. 4,076,842; and ZSM-35 in U.S. Pat. No. 4,016,245. All of the above patents are incorporated herein by reference. Other suitable medium-pore-size zeolites include the silicoaluminophosphates (SAPO), such as SAPO-4 and SAPO-11 which is described in U.S. Pat. No. 4,440,871; chromosilicates; gallium silicates; iron silicates; aluminum phosphates (ALPO), such as ALPO-11 described in U.S. Pat. No. 4,310,440; titanium aluminosilicates (TASO), such as TASO-45 described in EP-A No. 229,295; boron silicates, described in U.S. Pat. No. 4,254,297; titanium aluminophosphates (TAPO), such as TAPO-11 described in U.S. Pat. No. 4,500,651; and iron aluminosilicates.

The medium-pore-size zeolites can include "crystalline admixtures" which are thought to be the result of faults occurring within the crystal or crystalline area during the synthesis of the zeolites. Examples of crystalline admixtures of ZSM-5 and ZSM-11 are disclosed in U.S. Pat. No. 4,229,424 which is incorporated herein by reference. The crystalline admixtures are themselves medium-pore-size zeolites and are not to be confused with physical admixtures of zeolites in which distinct crystals of crystallites of different zeolites are physically present in the same catalyst composite or hydrothermal reaction mixtures.

The second stage catalysts are held together with an inorganic oxide matrix component. The inorganic oxide matrix component binds the catalyst components together so that the catalyst product is hard enough to survive interparticle and reactor wall collisions. The inorganic oxide matrix can be made from an inorganic oxide sol or gel which is dried to "bind" the catalyst components together. Preferably, the inorganic oxide matrix is not catalytically active and comprise oxides of silicon and aluminum. Preferably, separate alumina phases are incorporated into the inorganic oxide matrix. Species of aluminum oxyhydroxides-δ-alumina, boehmite, diaspore, and transitional aluminas such as α-alumina, β-alumina, γ-alumina, δ-alumina, ϵalumina, κ-alumina, and ρ-alumina can be employed. Preferably, the alumina species is an aluminum trihydroxide such as gibbsite, bayerite, nordstrandite, or doyelite.

Preferred second stage process conditions include temperatures from about 500° C. to about 650° C., preferably from about 525° C. to 600° C.; hydrocarbon partial pressures from about 10 to 40 psia (70–280 kPa), preferably from about 20 to 35 psia (140–245 kPa); and a second stage catalyst to naphtha (wt/wt) ratio from about 3 to 12, preferably from about 4 to 10, where the second stage catalyst weight is total weight of the second stage catalyst composite. Steam may be concurrently introduced with the naphtha stream into the reaction zone and comprise up to about 50 wt. % of the second stage feed. Preferably, the second stage feed residence time in the reaction zone be less than about 10 seconds, for example from about 1 to 10 seconds. The above conditions will be such that at least about 60 wt. % of the $C_5$+ olefins in the naphtha stream are converted to $C_4$− products and less than about 25 wt. %, preferably less than about 20 wt. % of the paraffins are converted to $C_4$− products, and that propylene comprises at least about 90 mol. %, preferably greater than about 95 mol. % of the total $C_3$ reaction products with the weight ratio of propylene/total $C_2$− products greater than about 3.5.

Preferably, ethylene comprises at least about 90 mol. % of the $C_2$ products, with the weight ratio of propylene:ethylene being greater than about 4, and that the "full range" $C_5$+ naphtha product is enhanced in both motor and research octanes relative to the naphtha feed. It is within the scope of this invention to pre-coke the second stage catalysts before introducing second stage feed to further improve the selectivity to propylene. It is also within the scope of this invention to feed an effective amount of single ring aromatics to the reaction zone of said second stage to improve the selectivity of propylene versus ethylene. The aromatics may be from an external source such as a reforming process unit or they may consist of heavy naphtha recycle product from the instant process.

The first stage and second stage regenerator flue gases are combined in one embodiment of this invention, and the light ends or product recovery section may also be shared with suitable hardware modifications. High selectivity to the desired light olefins products in the second stage lowers the investment required to revamp existing light ends facilities for additional light olefins recovery. The composition of the catalyst of the first stage is typically selected to maximize hydrogen transfer. In this manner, the second stage feed may be optimized for maximum $C_2$, $C_3$, and $C_4$ olefins yields with relatively high selectivity using the preferred second stage catalyst and operating conditions. Total high value light olefin products from the combined two stages include those generated with relatively low yield in the first stage plus those produced with relatively high yield in the second stage.

The following examples are presented for illustrative purposes only and are not to be taken as limiting the present invention in any way.

EXAMPLES 1–12

The following examples illustrate the criticality of process operating conditions for maintaining chemical grade propylene purity with samples of cat naphtha cracked over ZCAT-40 (a catalyst that contains ZSM-5) which had been steamed at 1500° F. for 16 hrs to simulate commercial equilibrium. Comparison of Examples 1 and 2 show that increasing Cat/Oil ratio improves propylene yield, but sacrifices propylene purity. Comparison of Examples 3 and 4 and 5 and 6 shows reducing oil partial pressure greatly improves propylene purity without compromising propylene yield. Comparison of Examples 7 and 8 and 9 and 10 shows increasing temperature improves both propylene yield and purity. Comparison of Examples 11 and 12 shows decreasing cat residence time improves propylene yield and purity. Example 13 shows an example where both high propylene yield and purity are obtained at a reactor temperature and cat/oil ratio that can be achieved using a conventional FCC reactor/regenerator design for the second stage.

TABLE 1

| Example | Feed Olefins, wt % | Temp. ° C. | Cat/Oil | Oil psia | Oil Res. Time, sec | Cat Res. Time, sec | Wt. % $C_3^=$ | Wt. % $C_3^-$ | Propylene Purity, % |
|---|---|---|---|---|---|---|---|---|---|
| 1 | 38.6 | 566 | 4.2 | 36 | 0.5 | 4.3 | 11.4 | 0.5 | 95.8% |
| 2 | 38.6 | 569 | 8.4 | 32 | 0.6 | 4.7 | 12.8 | 0.8 | 94.1% |
| 3 | 22.2 | 510 | 8.8 | 18 | 1.2 | 8.6 | 8.2 | 1.1 | 88.2% |
| 4 | 22.2 | 511 | 9.3 | 38 | 1.2 | 5.6 | 6.3 | 1.9 | 76.8% |
| 5 | 38.6 | 632 | 16.6 | 20 | 1.7 | 9.8 | 16.7 | 1.0 | 94.4% |
| 6 | 38.6 | 630 | 16.6 | 13 | 1.3 | 7.5 | 16.8 | 0.6 | 96.6% |
| 7 | 22.2 | 571 | 5.3 | 27 | 0.4 | 0.3 | 6.0 | 0.2 | 96.8% |
| 8 | 22.2 | 586 | 5.1 | 27 | 0.3 | 0.3 | 7.3 | 0.2 | 97.3% |
| 9 | 22.2 | 511 | 9.3 | 38 | 1.2 | 5.6 | 6.3 | 1.9 | 76.8% |
| 10 | 22.2 | 607 | 9.2 | 37 | 1.2 | 6.0 | 10.4 | 2.2 | 82.5% |
| 11 | 22.2 | 576 | 18.0 | 32 | 1.0 | 9.0 | 9.6 | 4.0 | 70.6% |
| 12 | 22.2 | 574 | 18.3 | 32 | 1.0 | 2.4 | 10.1 | 1.9 | 84.2% |
| 13 | 38.6 | 606 | 8.5 | 22 | 1.0 | 7.4 | 15.0 | 0.7 | 95.5% |

TABLE 1-continued

| Example | Wt. % $C_2^=$ | Wt. % $C_2^-$ | Ratio of $C_3^=$ to $C_2^=$ | Ratio of $C_3^=$ $C_2^=$ | Wt. % $C_3^=$ |
|---|---|---|---|---|---|
| 1 | 2.35 | 2.73 | 4.9 | 4.2 | 11.4 |
| 2 | 3.02 | 3.58 | 4.2 | 3.6 | 12.8 |
| 3 | 2.32 | 2.53 | 3.5 | 3.2 | 8.2 |
| 4 | 2.16 | 2.46 | 2.9 | 2.6 | 6.3 |
| 5 | 6.97 | 9.95 | 2.4 | 1.7 | 16.7 |
| 6 | 6.21 | 8.71 | 2.7 | 1.9 | 16.8 |
| 7 | 1.03 | 1.64 | 5.8 | 3.7 | 6.0 |
| 8 | 1.48 | 2.02 | 4.9 | 3.6 | 7.3 |
| 9 | 2.16 | 2.46 | 2.9 | 2.6 | 6.3 |
| 10 | 5.21 | 6.74 | 2.0 | 1.5 | 10.4 |
| 11 | 4.99 | 6.67 | 1.9 | 1.4 | 9.6 |
| 12 | 4.43 | 6.27 | 2.3 | 1.6 | 10.1 |
| 13 | 4.45 | 5.76 | 3.3 | 2.6 | 15.0 |

The above examples (1,2,7 and 8) show that $C_3^=/C_2^=>4$ and $C_3^=/C_2^->3.5$ can be achieved by selection of suitable reactor conditions.

EXAMPLES 14–17

The cracking of olefins and paraffins contained in naphtha streams (e.g. FCC naphtha, coker naphtha) over small or medium-pore zeolites such as ZSM-5 can produce significant amounts of ethylene and propylene. The selectivity to ethylene or propylene and selectivity of propylene to propane varies as a function of catalyst and process operating conditions. It has been found that propylene yield can be increased by co-feeding steam along with cat naphtha to the reactor. The catalyst may be ZSM-5 or other small or medium-pore zeolites. Table 2 below illustrates the increase in propylene yield when 5 wt. % steam is co-fed with an FCC naphtha containing 38.8 wt. % olefins. Although propylene yield increased, the propylene purity is diminished. Thus, other operating conditions may need to be adjusted to maintain the targeted propylene selectivity.

TABLE 2

| Example | Steam Co-feed | Temp. C | Cat/Oil | Oil psia | Oil Res. Time, sec | Cat Res. Time, sec | Wt % Propylene | Wt % Propane | Propylene Purity, % |
|---|---|---|---|---|---|---|---|---|---|
| 14 | No | 630 | 8.7 | 18 | 0.8 | 8.0 | 11.7 | 0.3 | 97.5% |
| 15 | Yes | 631 | 8.8 | 22 | 1.2 | 6.0 | 13.9 | 0.6 | 95.9% |
| 16 | No | 631 | 8.7 | 18 | 0.8 | 7.8 | 13.6 | 0.4 | 97.1% |
| 17 | Yes | 632 | 8.4 | 22 | 1.1 | 6.1 | 14.6 | 0.8 | 94.8% |

Light olefins resulting from the preferred process may be used as feeds for processes such as oligimerization, polymerization, co-polymerization, ter-polymerization, and related processes (hereinafter "polymerization") to form macromolecules. Such light olefins may be polymerized both alone and in combination with other species, in accordance with polymerization methods known in the art. In some cases it may be desirable to separate, concentrate, purify, upgrade, or otherwise process the light olefins prior to polymerization. Propylene and ethylene are preferred polymerization feeds. Polypropylene and polyethylene are preferred polymerization products made therefrom.

What is claimed is:

1. A process for producing polypropylene from $C_3$ olefins produced in a two stage process for selectively producing $C_2$ to $C_4$ olefins from a heavy hydrocarbon feed, the process comprising the steps of:

a) contacting a heavy hydrocarbon feed with a large-pore zeolitic catalytic cracking catalyst having an average pore diameter greater than about 0.7 nm in a first reaction stage comprising a fluid catalytic cracking unit to convert the heavy hydrocarbon feed to lower boiling reaction products;

b) fractionating said lower boiling reaction products into at least a naphtha boiling range fraction comprising between about 10 and about 30 wt. % paraffins and between about 15 and about 70 wt. % olefins;

c) contacting the naphtha boiling range fraction with a second catalyst comprising between about 10 and about 50 wt. % of a crystalline zeolite having an average pore diameter less than about 0.7 nm in a second reaction stage comprising a process unit comprising a reaction zone, a stripping zone, a second catalyst regeneration zone, and a fractionation zone, wherein the naphtha boiling range fraction is contacted with the second catalyst in the reaction zone at reaction conditions which include temperatures ranging from about 500 to 650° C. and a hydrocarbon partial pressure from about 10 to 40 psia and a catalyst to second stage feed weight ratio of about 4 to about 10, and wherein propylene comprises at least about 90 mol. % of the total $C_3$ product;

d) passing catalyst particles through the stripping zone;

e) passing the stripped second catalyst particles to the regeneration zone where coke is combusted from the second catalyst;

f) recycling the hot catalyst particles to the second stage reaction zone; and, g) separating the propylene and polymerizing the propylene to form polypropylene.

2. The process of claim 1 wherein the crystalline zeolite is selected from the group consisting of ZSM-5 and ZSM-11.

3. The process of claim 2 wherein the reaction temperature is from about 500° C. to about 600° C.

4. The process of claim 3 wherein at least about 60 wt. % of the $C_5$+ olefins in the naphtha boiling range feed is converted to $C_4$– products and less than about 25 wt. % of the paraffins are converted to $C_4$– products.

5. The process of claim 4 wherein the weight ratio of propylene to total $C_2$– products is greater than about 3.5.

6. The process of claim 1 wherein the large pore zeolitic catalytic cracking catalyst of the first stage is selected from the group consisting of gmelinite, chabazite, dachiardite, clinoptilolite, faujasite, heulandite, analcite, levynite, erionite, sodalite, cancrinite, nepheline, lazurite, scolecite, natrolite, offretite, mesolite, mordenite, brewsterite, ferrierite and the synthetic zeolites X, Y, A, L, ZK-4, ZK-5, B, E, F, H, J, M, Q, T, W, Z, alpha, beta, and omega, and USY.

7. The process of claim 6 wherein the large pore zeolitic catalytic cracking catalyst is a USY zeolite.

8. The process according to claim 1 wherein propylene comprises at least about 95 mol. % of the total $C_3$ products.

* * * * *